United States Patent [19]

Conrad

[11] Patent Number: 4,946,053

[45] Date of Patent: Aug. 7, 1990

[54] OVALIZED LABEL PANEL FOR ROUND HOT FILLED PLASTIC CONTAINERS

[75] Inventor: George R. Conrad, Dunwoody, Ga.

[73] Assignee: General Electric Company, Mt. Vernon, Ind.

[21] Appl. No.: 407,827

[22] Filed: Sep. 15, 1989

[51] Int. Cl.[5] ..... B65D 1/02; B65D 23/00; B65D 23/10

[52] U.S. Cl. ..... 215/1 C; 220/72; 220/94 A; 215/100 A

[58] Field of Search ..... 40/310; 215/1 C, 12.1, 215/100 A; 220/72, 94 A; D9/378, 391, 392

[56] References Cited

U.S. PATENT DOCUMENTS

| | | | |
|---|---|---|---|
| D. 211,927 | 8/1968 | Phelan | D9/378 |
| D. 282,050 | 1/1986 | Beaver et al. | D9/391 X |
| 3,923,178 | 12/1975 | Welker | 215/1 C |
| 4,280,630 | 7/1981 | Hafele | 215/1 CX |
| 4,280,859 | 7/1981 | Thompson | 215/1 C |
| 4,381,061 | 4/1983 | Cerny et al. | 215/1 C |
| 4,387,816 | 6/1983 | Weckman | 215/1 C |
| 4,610,366 | 9/1986 | Estes et al. | 215/1 C |
| 4,749,092 | 6/1988 | Sugiura et al. | 215/1 C |
| 4,805,788 | 2/1989 | Akiho | 215/1 C |

FOREIGN PATENT DOCUMENTS

| | | | |
|---|---|---|---|
| 1009146 | 1/1989 | Japan | 215/1 C |
| 2041286 | 9/1980 | United Kingdom | 215/1 C |

*Primary Examiner*—Sue A. Weaver

*Attorney, Agent, or Firm*—Martin B. Barancik; Joseph T. Eisele

[57] ABSTRACT

A plastic container for use in receiving product in a hot state the sealing of which creates a negative pressure therein after the product cools, an ovalized portion of the container disposed between a bottom and shoulder having circular cross sections wherein the negative pressure causes a uniform deformation of the ovalized portion allowing the container to remain aesthetically pleasing in appearance.

7 Claims, 2 Drawing Sheets

FIG. 1
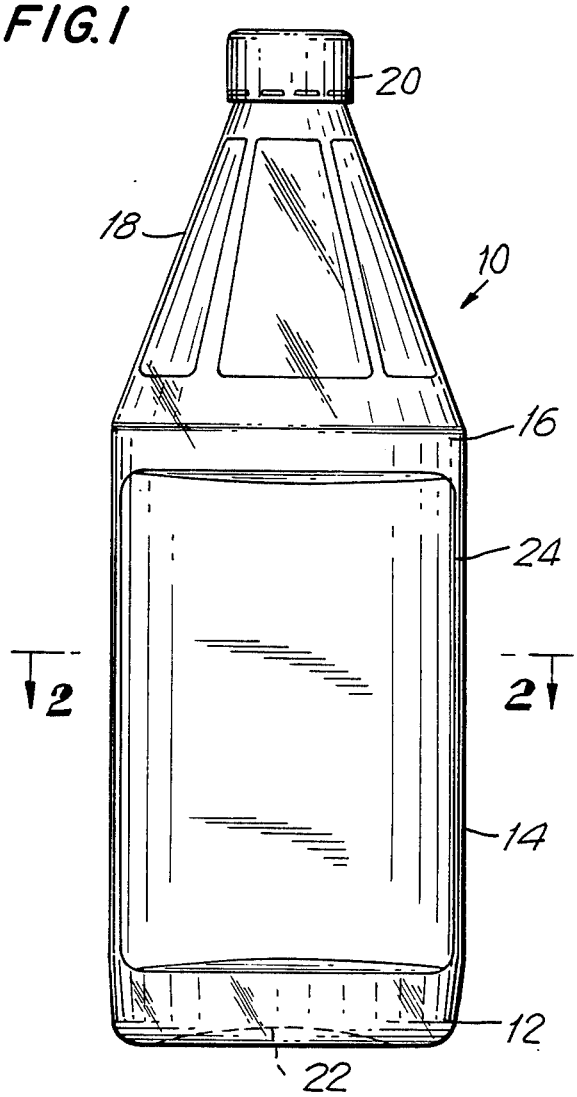
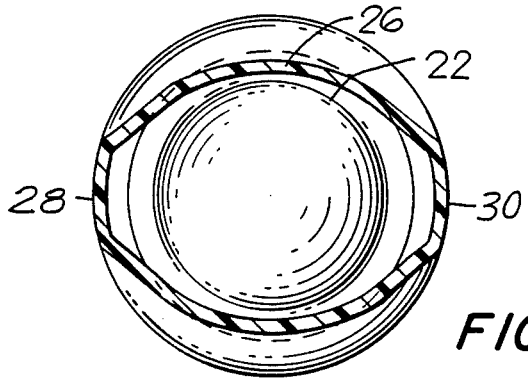
FIG. 2

OVALIZED LABEL PANEL FOR ROUND HOT FILLED PLASTIC CONTAINERS

FIELD OF INVENTION

The present invention is directed toward a container fabricated out of a plastic material which allows for the hot filling of contents therein without undesired deformation thereof.

BACKGROUND OF INVENTION

In the packaging industry, particularly the food packaging industry for liquids, containers are typically fabricated out of glass, plastic or coated cardboard (i.e. milk containers). In filling such containers, the shape of the container is important to the filling process. For example, there presently exists a large number of filling facilities using round fill line equipment for round containers i.e. round in the sense of having a circular cross section along its longitudinal axis at the top and bottom of the container. Such equipment also provides for the filling of hot liquid into the container.

Such hot filling of round containers is very popular but is predominated by the use of glass containers. One of the reasons glass is typically used in a hot fill situation is that the container must be fairly rigid so that the vacuum collapse after the filling of the hot liquid does not cause the container to distort. While it is desireable to use containers made of different material such as plastic which is relatively inexpensive, because of the flexible nature of such material, especially with thin gauges, distortion of the product does occur due to the vacuum collapse. This obviously renders the resulting product unappealing from a marketing stand point.

Thus there exists a need for a plastic container which can be used in containing hot filled product without the distorting effect heretofore realized.

SUMMARY OF THE INVENTION

Accordingly, it is a principle object of the invention to provide for a plastic container which is capable of being hot filled without attendant undesirable distortion.

It is another object of the invention to provide for a plastic container for hot fill applications which can be used in centered round fill lines and conveying equipment commonly used in filling glass containers.

The present invention is directed towards providing a container, particularly one made out of a plastic material, which can be used with existing glass filling and conveying equipment in a hot fill situation. The container is provided with a round base and rounded upper shoulder. A neck portion is provided above the shoulder on which is centered an opening for filling the container. Between the upper shoulder and bottom is an intermediate or center area typically used to affix a label and is commonly referred to as a label panel area. The label panel area has a cross section which approximates that of an oval within the circular cross sectional dimension defined by the upper shoulder and bottom. The material used in the label panel area is typically the thinnest and therefor the weakest. The ovalized dimension of the label panel area allows for the container to be subject to a negative pressure or vacuum, which results from a hot fill situation, without unsightly distortion. In this regard, after the container is filled with hot contents and sealed, upon a cooling of the contents a vacuum is created therein. Due to the flatter nature of the container in the label panel area, there will be a uniform sucking in at that point. Such uniform action does not result in a noticeable distortion of the container as would result with a round container (i.e. dents form) Thus the plastic container can be used in round hot fill line equipment and conveyors while remaining aesthetically pleasing after the filling and sealing thereof.

BRIEF DESCRIPTION OF THE DRAWINGS

Thus by the present invention, its objects and advantages will be realized, the description of which should be taken in conjunction with the drawings wherein:

FIG. 1 is a side perspective view of a plastic container of a nominal quart size, incorporating the teachings of the present invention;

FIG. 2 is a top sectional view of the container shown in FIG. 1 taken along line 2—2;

DETAILED DESCRIPTION OF THE PREFERRED EMBODIMENT

Figure 3:
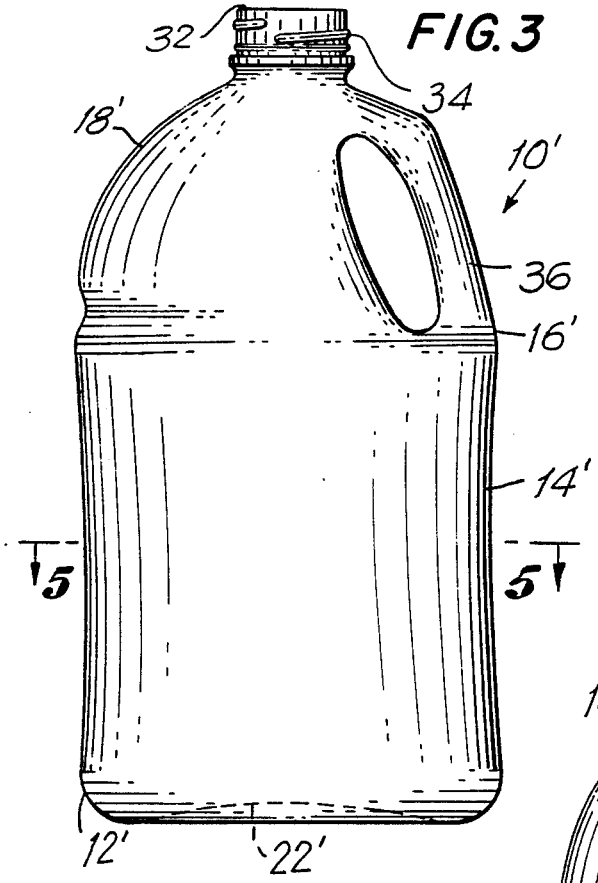
FIG. 3 is a rear perspective view of a nominal gallon size plastic container, incorporating the teachings of the present invention.

Turning now more particularly to the drawings, in FIG. 1 there is shown a container 10 which is integrally constructed and made of a plastic material. The container 10 is specifically designed to allow its use on conventional round container fill lines and conveyors with center hot fill operators. Some minor modification of the equipment may however be necessary to convert the filling and conveying machines from using glass to plastic containers.

The container 10 includes a circular, cross section flat bottom portion 12 which is joined with a center or label portion 14. Further up the container 10, the label portion 14 joins with an upper shoulder 16 which has the same circular cross sectional dimension of the bottom portion 12. Above the shoulder 16 is a neck portion 18 which terminates in an opening (not shown) which may be closed by a tamper evident screw cap 20 or the like. The opening to the container is centered with respect to the center axis of the container 10 defined by the cross section of the shoulder 16 and bottom portion 12. This allows for a center filling of the container 10 with the desired contents.

The bottom portion 12 may include a recessed portion 22 as outlined in FIG. 2 which is common in the container packaging industry.

As to the label portion 14, it is referred as such since a label is commonly placed on this portion of the container 10. The thickness of the wall 24 of the container 10 at this point is generally the thinnest with respect to the rest of the container 10. This is for example due to the fact that the shoulder 16 and bottom 12 have to be fairly strong for purposes of conveying and packaging since they act as a type of bumper. The neck portion 18 need also be strengthened to accommodate the use of a cap 20. Accordingly, the place where material can be saved is in the label portion 14.

The cross section of the label portion 14 is ovalized as shown at 26 in FIG. 2. In this regard, the label portion 14 has a somewhat flattened cross section as compared to that of the shoulder 16 and bottom portion 12. At opposite sides 28 and 30 of the label portion 14 the dimension of the label portion 14 conforms to that of the dimension of the shoulder 16 and bottom portion 14.

As a result of the configuration of the label portion 14, it creates relatively flat planes which are subject to uniform deformation. In this regard, after the container 10 is filled with desired hot contents, sealed and the contents cools, a vacuum is created within the container 10. This causes a sucking in action on the container 10 sidewalls. Since the container 10 is thinnest at the label portion 14, the effect of the vacuum will be felt the greatest there. However due to the ovalized shape of the label portion 14 there will be a uniform deformation or flattening at this area as compared to the formation of a dent or the like. Because of the uniformity of the deformation it will not be perceived as defective packaging but rather maintains an aesthetically pleasing appearance.

Figure 5:
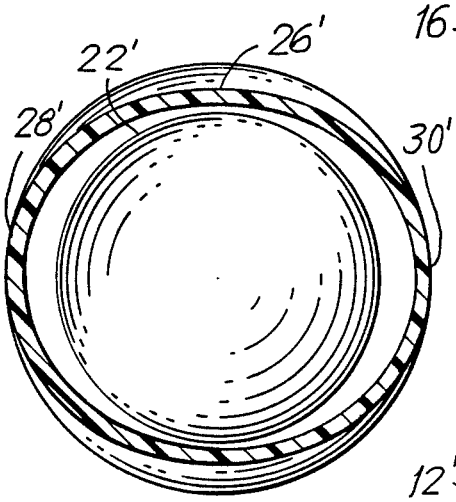
FIG. 5 is a top sectional view of the container shown in FIGS. 3 and 4 taken along line 5—5 of FIG. 3.
Figure 4:
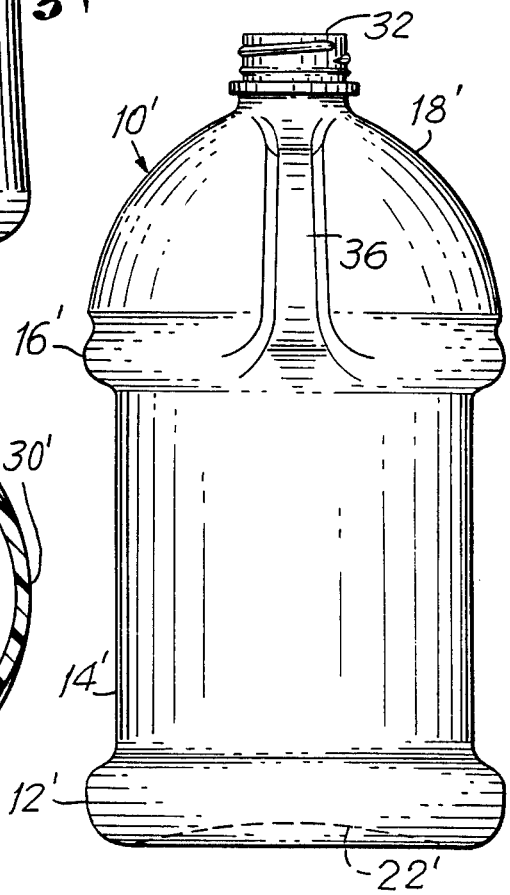
FIG. 4 is a side perspective view of the container shown in FIG. 1.

Turning now to FIGS. 3–5, parts similar to those identified with regard to FIGS. 1 and 2 will be similarly numbered but however will be designated with a prime.

The container 10' shown in FIGS. 3–5 represents one having a capacity of approximately a gallon. The container 10' includes a bottom portion 12' having a recess 22' therein, label portion 14', upper shoulder 16' and neck portion 18'. Shown at the top of the neck portion 18' is an opening 32 centered with the center axis of the container 10' and includes a helical thread 34 for the attachment of a cap (not shown).

To provide a convenient means for carrying and pouring the container 10', a handle 36 is formed in the neck portion 18'.

As shown in FIG. 5, the ovalized cross section of the label portion 14' is shown at 26'. As distinct from the previous embodiment, there is a more gradual return of the cross section of the label portion at 28' and 30' to that of the cross section of the shoulder 16' and bottom portion 12'. This does not however effect the purpose and operation of the label portion 14' as aforediscussed with regard to FIGS. 1 and 2 but merely constitutes a design variation. The utility and advantages of the containers are the same.

Thus by the present invention its objects and advantages are realized. Although preferred embodiments have been disclosed and described in detail herein, the scope of the invention should not be limited thereby, rather its scope should be determined by that of the appended claims.

What is claimed is:

1. A plastic container for use in containing a product which is filled therein a hot state and then sealed with the cooling of such product creating a negative pressure in said container, comprising, a bottom portion having a circular cross section;

a shoulder portion having a circular cross section corresponding to the cross section of the bottom portion, said bottom and shoulder portions in axial alignment;

a neck portion coupled to the shoulder portion having an opening therein so as to allow the ingress and egress of a product contained in the container;

a label portion disposed between the bottom and shoulder portion and coupled therewith, said label portion having an ovalized cross section of approximately the same dimension throughout its length with respect to the circular cross section of the bottom and shoulder portion; and wherein upon the creation of a negative pressure in the container the label portion is subject to uniform deformation inwardly causing a straightening thereof so as not to distort the appearance of the container.

2. The container in accordance with claim 1 which includes a side wall of the container defined by said bottom, label, shoulder and neck portions with the thickness of the sidewall the thinnest at said label portion.

3. The container in accordance with claim 2 wherein said opening in said neck portion is positioned along the center axis of the container as defined by the axis of the cross sections of the bottom and shoulder portions.

4. The container in accordance with claim 1 wherein said opening is defined by a threaded portion which receives a threaded cap capable of sealing and unsealing said container.

5. The container in accordance with claim 4 which includes a handle means formed in the neck portion which facilitates grasping the container.

6. The container in accordance with claim 1 wherein said opening in said neck portion is positioned along the center axis of the container as defined by the axis of the cross sections of the bottom and shoulder portions.

7. The container in accordance with claim 6 which includes a handle means formed in the neck portion which facilitates grasping the container.

* * * * *